US007173640B2

(12) United States Patent
Mas et al.

(10) Patent No.: US 7,173,640 B2
(45) Date of Patent: Feb. 6, 2007

(54) DISPLAY OF AN IMAGE ON AN ARRAY SCREEN BY SELECTIVE ADDRESSING OF SCREEN LINES

(75) Inventors: Céline Mas, Poisat (FR); Eric Benoit, Quaix en Chartreuse (FR); Olivier Scouarnec, Saint Nazaire les Eymes (FR); Olivier Le Briz, Saint-Gervais (FR)

(73) Assignee: STMicroelectronics S.A., Montrouge (FR)

( * ) Notice: Subject to any disclaimer, the term of this patent is extended or adjusted under 35 U.S.C. 154(b) by 387 days.

(21) Appl. No.: 10/622,368

(22) Filed: Jul. 18, 2003

(65) Prior Publication Data

US 2004/0051725 A1 Mar. 18, 2004

(30) Foreign Application Priority Data

Jul. 19, 2002 (FR) ..... 02 09228

(51) Int. Cl.
*G09G 5/02* (2006.01)
*G09G 3/36* (2006.01)

(52) U.S. Cl. ..... 345/694; 345/98

(58) Field of Classification Search ..... 345/694, 345/581–618, 690, 98, 204, 87; 340/815.55; 358/1.9–3.32

See application file for complete search history.

(56) References Cited

U.S. PATENT DOCUMENTS 5,594,463 A 1/1997 Sakamoto
5,726,679 A * 3/1998 Kanno et al. ..... 345/100
5,929,831 A * 7/1999 Aratani et al. ..... 345/97
2001/0043206 A1 11/2001 Naito et al.
2002/0196243 A1 * 12/2002 Morita ..... 345/204

OTHER PUBLICATIONS

French Search Report from French Patent Application 02/09228, filed Jul. 19, 2002.

French Search Report from French Patent Application 02/09229, filed Jul. 19, 2002.

French Search Report from French Patent Application 02/09227, filed Jul. 19, 2002.

* cited by examiner

*Primary Examiner*—Amr A. Awad
*Assistant Examiner*—Stephen G Sherman
(74) *Attorney, Agent, or Firm*—Lisa K. Jorgenson; James H. Morris; Wolf, Greenfield & Sacks, P.C.

(57) ABSTRACT

A method for displaying an image on an array screen by activation of screen pixels arranged in rows and columns, each pixel of a same row corresponding to a memory point of a same memory row, the memory point being set to an activation state when the corresponding pixel is to be activated, including the steps of identifying, among sets of the memory rows, the row sets for which at least one memory point of a row of the set is at the activation state; and successively selecting the only lines corresponding to the rows of the sets of rows identified for the pixel activation. The present invention also provides a device for displaying an image on an array screen.

8 Claims, 2 Drawing Sheets

DISPLAY OF AN IMAGE ON AN ARRAY SCREEN BY SELECTIVE ADDRESSING OF SCREEN LINES

BACKGROUND OF THE INVENTION

1. Field of the Invention

The present invention relates to a method and a device for displaying an image on an array screen by activation of screen pixels arranged in rows and columns.

2. Discussion of the Related Art

The present invention especially applies to array screens in which each pixel is formed of a light-emitting diode, for example, of organic or polymer nature (OLED-type screen, for Organic Light-Emitting Display, or PLED, for Polymer Light-Emitting Display). The cathodes of the diodes of a same line are connected to a row electrode and the anodes of the diodes of a same column are connected to a column electrode.

The display of an image on screen, according to usual standards, is obtained by the display of a frame or of two successive frames. Upon display of a frame, the addressing of an array screen is performed row after row via a row control circuit (commonly called the row driver). In the case of an array screen with diodes, the row electrode of the active row may be grounded while the other row electrodes may be left at high impedance or be connected to a high voltage. Simultaneously, the information corresponding to the activation or to the non-activation of the row pixels will be transmitted by the column electrodes via a column control circuit (column driver) which injects or does not inject a current into each electrode column to turn on or to not turn on the column pixel.

It is possible for no pixel of one or several rows to be on upon display of several successive frames, for example, in some applications for portable phone screens or electronic diary screens. Now, such lines will be however activated upon successive addressing of all the screen lines. The power necessary for the row driver to address lines where no pixel is turned on is then uselessly wasted.

Further, in the case of an array screen with light-emitting diodes, upon activation of a row, there often is a previous step of precharge of all the diodes of the row to a voltage close to the threshold voltage. The possible turning-on of the diodes can then be obtained more rapidly. In the base where no pixel in the row is to be activated, the power required for the precharge step is uselessly wasted.

SUMMARY OF THE INVENTION

The present invention aims at a method and a device for displaying an image on an array screen by activation of screen pixels arranged in rows and columns enabling power saving.

The present invention also aims at a method and a device for displaying an image on an array screen with diodes enabling improving of the pixel screen lifetime.

To achieve these and other objects, the present invention provides a method for displaying an image on an array screen by activation of screen pixels arranged in rows and columns, each pixel of a same row corresponding to a memory point of a same row of the memory, said memory point being set to an activation state when the corresponding pixel is to be activated, comprising the steps of identifying, among sets of the memory rows, the row sets for which at least one memory point of a row of the set is at the activation state; and successively selecting the only lines corresponding to the rows of the sets of rows identified for the pixel activation.

According to an embodiment of the present invention, the first step comprises the steps of setting, for each row of the memory, a memory point of an auxiliary memory to the activation state if at least one memory point of the row is at the activation state; determining the memory points of the auxiliary memory at the activation state; and identifying the row blocks corresponding to said memory points of the auxiliary memory in the activation state.

According to an embodiment of the present invention, the first step comprises the steps of setting, for each row of the memory, a memory point of an auxiliary memory to the activation state if a memory point of the row is set to the activation state; determining the memory points of the auxiliary memory in the activation state; and identifying the row blocks corresponding to said memory points of the auxiliary memory in the activation state.

According to an embodiment of the present invention, the method further comprises the steps of reading, for each selected row, the states of the memory points of the selected row; and setting a memory point of the auxiliary memory to the deactivation state if all the memory points of the row are in the deactivation state.

According to an embodiment of the present invention, the method further comprises, before the second step, the steps of determining a clock signal for reading the number of sets of identified rows, the lines of the screen being selected at the frequency of said read clock signal.

According to an embodiment of the present invention, the frequency of the read clock signal multiplied by the total number of rows of the sets of identified rows is substantially constant.

According to an embodiment of the present invention, when a set of rows has contained at least one memory point in the activation state for the display of a determined image, the lines of the screen corresponding to said set of rows is selected, at least for the display of the next image, even if all the memory points of said set of rows are in the deactivation state.

The present invention also provides a device for displaying an image on an array screen by activation of screen pixels arranged in lines and columns, comprising a main memory, each pixel of a same screen line corresponding to a memory point of a same row of the main memory, said memory point being set to an activation state when the corresponding pixel is to be activated; an addressing means for successively providing row addresses of the main memory; a read means, receiving said successive identifiers, and adapted to read, for each address, the states of the memory points of the corresponding row; a row driver for selecting screen lines based on the addresses; and a column driver for activating pixels of the selected lines, further comprising a means for identifying, among sets of memory rows, sets of rows for which at least one memory point of a row in the set is in the activation state, and the addressing means is adapted to successively providing the row addresses of the identified row sets.

According to an embodiment of the present invention, the device comprises a means for providing a read control signal transmitted to the addressing means, the frequency of which depends on the total number of rows of the identified row sets.

According to an embodiment of the present invention, the device further comprises an auxiliary memory connected to the identification means and each memory point of which is associated with a row of the main memory and is in the activation state if a memory point of the corresponding row is in the activation state.

The foregoing objects, features and advantages of the present invention, will be discussed in detail in the following non-limiting description of specific embodiments in connection with the accompanying drawings.

DETAILED DESCRIPTION

Figure 1:
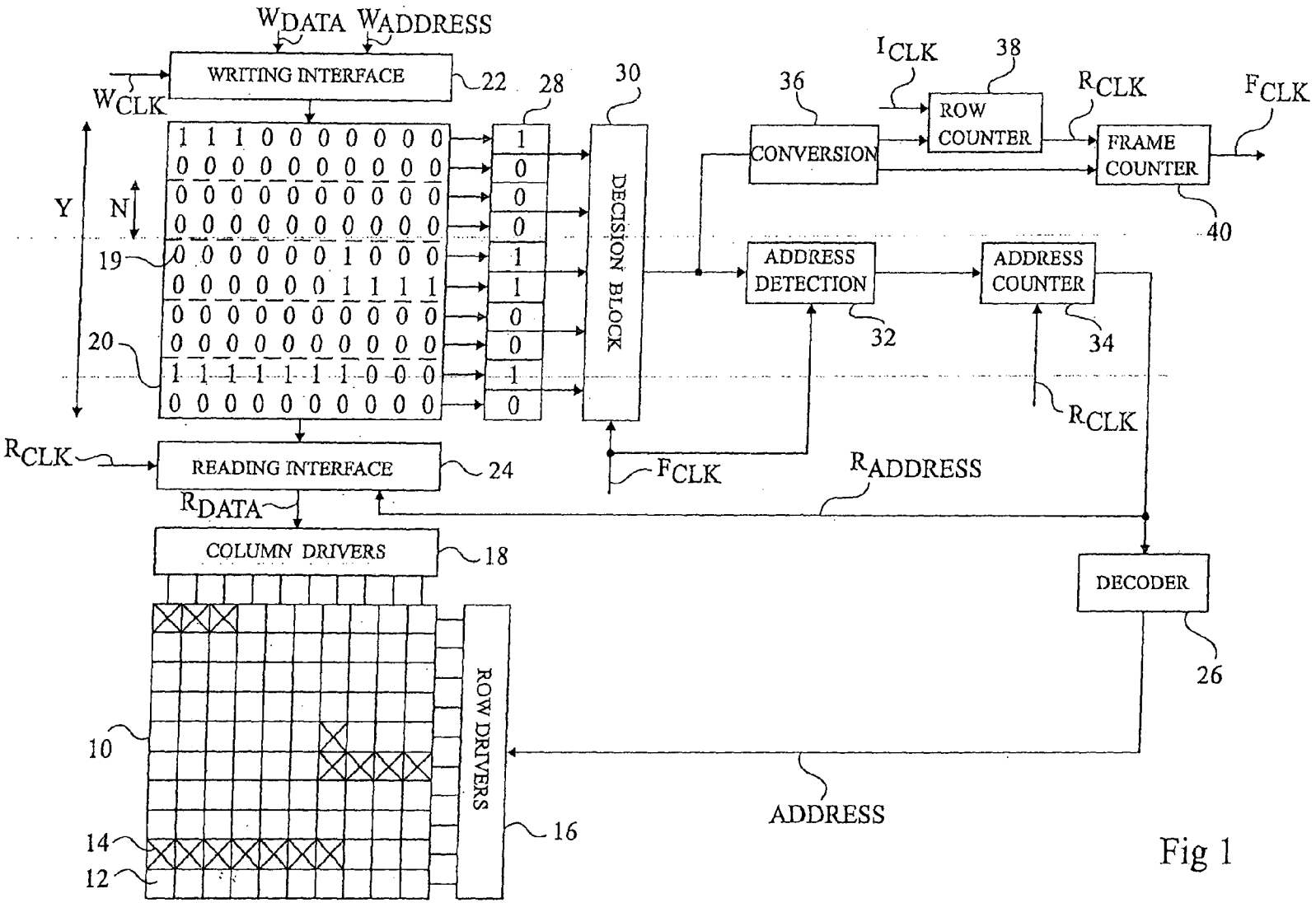
FIG. 1 schematically shows a first embodiment of a device for displaying an image on an array screen.

FIG. 1 shows an array screen 10, each box 12 of which corresponds to a pixel. It may be an array screen with diodes where each pixel is formed of a light-emitting diode, for example, organic or polymer. On pixels are symbolized by a cross 14. The addressing of pixels 12 is performed by a row driver 16 and a column driver 18.

Each pixel 12 is associated with a memory point 19 of a main memory 20, for example, a RAM. Memory points 19 are arranged in Y rows and in X columns and may be set to state 0 or to state 1 via a writing interface 22 which receives data to be written $W_{DATA}$ as well as addresses $W_{ADDRESS}$ of these data. Writing interface 22 is controlled by a write clock signal $W_{CLK}$. The frame to be displayed on screen 10 is previously stored in digital form in main memory 20. As an example, a memory point 19 is set to 1 when the corresponding pixel 12 of screen 10 is to be turned on, and set to 0 otherwise.

The states of all the memory points 19 in a row may be read by a reading interface 24 at the frequency of a ready clocking signal $R_{CLK}$. Reading interface 24 receives an addressing signal $R_{ADDRESS}$ indicating the row of main memory 20 to be read. Reading interface 24 then provides column driver 18 with data $R_{DATA}$ representing the states of the memory points 19 of address row $R_{ADDRESS}$. Row driver 16 also receives an address signal ADDRESS corresponding to the image of the $R_{ADDRESS}$ provided by a decoder 26 and which enables activation of the screen line of screen 10 associated with the row address $R_{ADDRESS}$ of main memory 20. Row driver 16 then activates the line of screen 10 corresponding to address ADDRESS and column driver 18 turns on or not the pixels 12 of the line activated according to data $R_{DATA}$.

The display device comprises an auxiliary memory 28 comprising Y memory points. In the embodiment illustrated in FIG. 1, main memory 20 and auxiliary memory 28 are designed so that a memory point of auxiliary memory 28, associated with a row of main memory 20, is at 0 if all the memory points in the row are at 0 and is at 1 if at least one memory point in the row is at 1.

The Y rows of main memory 20 are gathered in A blocks, each comprising N successive rows. Based on the state of the memory points of auxiliary memory 28, a decision unit 30 determines, among the A row blocks, K so-called "active" row blocks, each comprising at least one memory point at state 1. Integer K may be zero if all the memory points of main memory 20 are at 0. Decision unit 30 may comprise a register with A memory points, each memory point being set to 1 if the corresponding row block is "active". An address detection unit 32 (ADDRESS DETECTION) determines, based on data provided by decision unit 30, a list of the row addresses of main memory 20 belonging to the K "active" row blocks.

Decision unit 30 and address detection unit 32 are controlled by a frame clock signal $F_{CLK}$, the frequency of which corresponds to the display frequency of a frame on screen 10.

Address detection unit 32 controls an address counter 34 which provides, at the frequency of read clock signal $R_{CLK}$, the address $R_{DATA}$ of the rows of the K "active" blocks. Address counter 34 transmits addresses $R_{ADDRESS}$ in an order such that the lines of screen 10 are activated, for example, from top to bottom of the screen.

Accordingly, on display of the frame corresponding to the data written into main memory 20, reading interface 24 receives, at the frequency of read clock signal $R_{CLK}$, the successive addresses $R_{ADDRESS}$ corresponding only to the rows of main memory 20 belonging to the K "active" row blocks, that is, for which at least one memory point of main memory 20 is at 1.

Concurrently, address counter 34 transmits, via decoder 26, the addresses to row driver 16. Accordingly, row driver 16 only activates the rows of screen 10 which are associated with a row of main memory 20 belonging to one of the K "active" row blocks. According to the first embodiment of the present invention, upon display of a frame, the lines of screen 10 corresponding to rows of main memory 20 belonging to a row block, all the memory points of which are at 0, are not activated. Power savings are thus achieved.

It is desirable for the frame display frequency to remain substantially constant whatever the number of rows of screen 10 activated upon display of a frame. For this purpose, before display of a frame, decision unit 30 transmits to a conversion unit 36 a signal indicating which are the K "active" blocks. Conversion unit 36 determines a multiplicative factor by which the frequency of a clock signal $I_{CLK}$ internal to the display device must be multiplied to obtain the adequate frequency of read clock signal $R_{CLK}$ for the frequency of frame clock signal $F_{CLK}$ to be substantially constant. Conversion unit 36 transmits the value of the multiplicative factor to a row counter 38 which provides, based on internal control signal $I_{CLK}$ read clock signal $R_{CLK}$. Read clock signal $R_{CLK}$ is especially transmitted to counter 34 and to reading interface 24. Read clock signal $R_{CLK}$ is also transmitted to a frame counter 40 which provides frame clock signal $F_{CLK}$.

Generally, a frame frequency $F_{CLK}$ around 60 hertz or around 120 hertz according to the used standards is desired to be obtained. Given the numerical calculations performed by conversion unit 36, row counter 38, and frame counter 40, the variations of frame clock signal frequency $F_{CLK}$ remain under 2%. For example, for an array screen of 64 lines and 128 columns, the variations of frame clock frequency $F_{CLK}$ are smaller than 1.25%.

Figure 2:
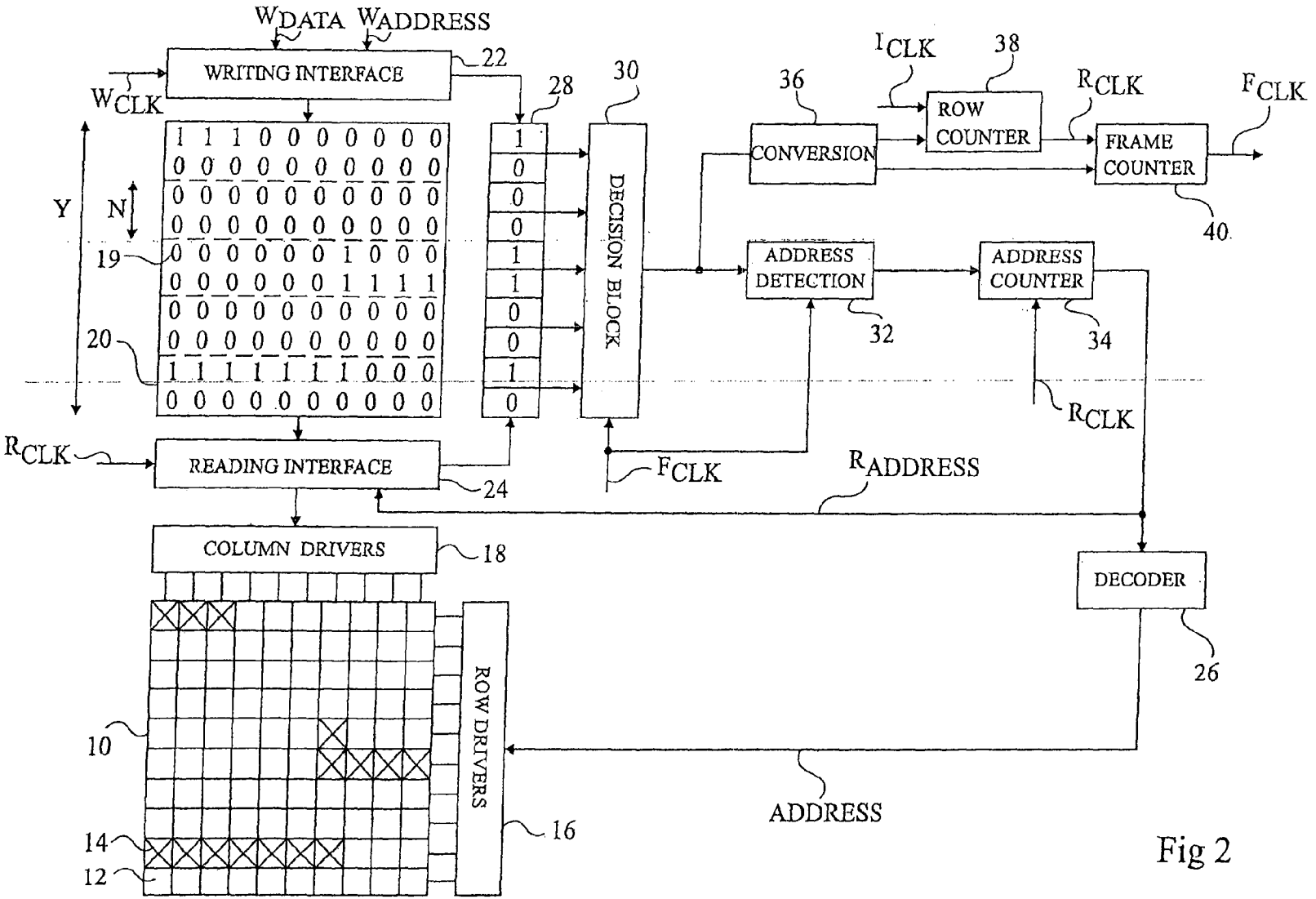
FIG. 2 schematically shows a second embodiment of the display device.

FIG. 2 shows a second embodiment of the display device according to the present invention.

Writing interface 22 is connected to auxiliary memory 28 which is not linked to main memory 20. Each time writing interface 22 sets to 1 a memory point 19 of a row of main memory 20, it transmits to auxiliary memory 28 a signal so that the memory point of auxiliary memory 28 associated with said row is set to 1. In the case where writing interface 22 sets a memory point of main memory 20 to 0, no signal is transmitted to auxiliary memory 28.

Reading interface 24 is also connected to auxiliary memory 28. Upon display of a frame, reading interface 24 receiving an address $R_{ADDRESS}$ corresponding to a row of main memory 20 determines whether at least one memory point of said row is at 1. If it is so, reading interface 24 transmits to auxiliary memory 28 a signal so that the memory point of auxiliary memory 28 associated with said read row is set to 1 or transmits no signal to auxiliary memory 28.

In the case where all the pixels of address row $R_{ADDRESS}$ of main memory 20 are at zero, reading interface 24 transmits to auxiliary memory 28 a signal so that the memory point of auxiliary memory 28 corresponding to said row is set to zero.

In the second embodiment according to the present invention, the modifications of the states of the memory points of auxiliary memory 28 are thus performed at two different steps. Indeed, the writing interface enables indicating that a memory point is set to state 1 and thus that the row block to which said memory point belongs must be selected upon display. Reading interface 24 may enables determining that all the memory points of a row block are at 0, and thus that the lines associated with this block will not be activated upon display of the next frame if the memory points of the rows of said row block are maintained at 0. The second embodiment enables use of a conventional main memory 20.

According to an alternative of the two embodiments, when at least one of the memory points of auxiliary memory 28 associated with a row block is at 1, and thus the block is "active" and, upon display of the next frame, all the memory points of the block are at 0, decision unit 30 can decide to maintain the block "active". The corresponding rows of screen 10 will thus be activated upon display of the next frame. This enables avoiding too frequent activation and deactivation changes for the rows of screen 10. The maintaining in the "active" state of a row block only comprising memory points at 0 may extend over several successive frames.

The present invention enables saving power by reducing the number of screen lines activated in the case where all the pixels of some rows are off. In the case of an array screen with diodes for which a precharge of the diodes is performed before turning on the pixels, the present invention enables avoiding the row charges and discharges where all the pixels are off.

Further, the present invention enables increasing the period of read clock signal $R_{CLK}$ with respect to a display in which all the screen lines would be systematically activated. In the specific case of an array screen with diodes, the luminance emitted by a pixel is proportional to the on duration of said pixel. The increase of the period of read signal $R_{CLK}$, which corresponds to the duration of activation of a screen row, then enables, for a same luminance, decreasing the amplitude of the control signal to be provided to the pixel. This thus enables further decreasing the total consumption of the array screen and improving of the pixel lifetime.

Of course, the present invention is likely to have various alterations, modifications, and improvements which will readily occur to those skilled in the art. Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A method for displaying an image on an array screen by activation of screen pixels arranged in lines and columns, each pixel of a same line corresponding to a memory point of a same row of a memory, said memory point being set to an activation state when a corresponding pixel is to be activated, comprising the steps of:

identifying, among sets of memory rows, the row sets for which at least one memory point of a row of the set is at the activation state;

determining a read clock signal based on the number of sets of identified rows; and successively selecting, at the frequency of said read clock signal, each line corresponding to the rows of the sets of rows identified for the pixel activation.

2. The method of claim 1 wherein the first step comprises the steps of:

setting, for each row of the memory, a memory point of an auxiliary memory to the activation state if at least one memory point of the row is at the activation state;

determining the memory points of the auxiliary memory at the activation state; and identifying the row blocks corresponding to said memory points of the auxiliary memory in the activation state.

3. The method of claim 1, wherein the first step comprises the steps of:

setting, for each row of the memory, a memory point of an auxiliary memory to the activation state if a memory point of the row is set to the activation state;

determining the memory points of the auxiliary memory in the activation state; and identifying the row blocks corresponding to said memory points of the auxiliary memory in the activation state.

4. The method of claim 3, further comprising the steps of:

reading, for each selected row, the states of the memory points of the selected row; and setting a memory point of the auxiliary memory to the deactivation state if all the memory points of the row are in the deactivation state.

5. The method of claim 1, wherein the frequency of the read clock signal multiplied by the total number of rows of the sets of identified rows is substantially constant.

6. The method of claim 1, wherein when a set of rows has contained at least one memory point in the activation state for the display of a determined image, the lines of the screen corresponding to said set of rows are selected, at least for the display of the next image, even if all the memory points of said set of rows are in the deactivation state.

7. A device for displaying an image on an array screen by activation of screen pixels arranged in lines and columns, comprising:

a main memory, each pixel of a same screen line corresponding to a memory point of a same row of the main memory, said memory point being set to an activation state when the a corresponding pixel is to be activated;

an addressing means for successively providing row addresses of the main memory;

a read means, receiving said successive row addresses, and adapted to read, for each address, the states of the memory points of the corresponding row;

a row driver for selecting screen lines based on the addresses; and a column driver for activating pixels of the selected lines, comprising a means for identifying, among sets of memory rows, sets of rows for which at least one memory point of a row in the set being in the activation state, a means for providing a read control signal transmitted to the addressing means, the frequency of which depends on the total number of rows of the identified row sets and wherein the addressing means is adapted to successively provide the row address of each row of the identified row sets at the frequency of the read control signal.

8. The device of claim 7, further comprises an auxiliary memory connected to the identification means and each memory point of which is associated with a row of the main memory and is in the activation state if a memory point of the corresponding row is in the activation state.

* * * * *

UNITED STATES PATENT AND TRADEMARK OFFICE

CERTIFICATE OF CORRECTION

PATENT NO. : 7,173,640 B2
APPLICATION NO. : 10/622368
DATED : February 6, 2007
INVENTOR(S) : Céline Mas et al.

It is certified that error appears in the above-identified patent and that said Letters Patent is hereby corrected as shown below:

Col. 1, line 46, should read:
--diodes can then be obtained more rapidly. In the case where--

Col. 6, line 52, should read:
--state when a corresponding pixel is to be activated;--

Signed and Sealed this

Third Day of April, 2007

JON W. DUDAS
*Director of the United States Patent and Trademark Office*